US005386956A

United States Patent [19]

Hatcher

[11] Patent Number: 5,386,956

[45] Date of Patent: Feb. 7, 1995

[54] ADJUSTABLE WRIST SUPPORT FOR USE WITH OFFICE MACHINES HAVING A KEYBOARD

[75] Inventor: David M. Hatcher, Buffalo, N.Y.

[73] Assignee: Posting Equipment Corporation, Buffalo, N.Y.

[21] Appl. No.: 33,335

[22] Filed: Mar. 18, 1993

[51] Int. Cl.[6] ..... B43L 15/00

[52] U.S. Cl. ..... 248/118; 248/118.3; 248/918

[58] Field of Search ..... 248/118, 118.1, 118.3, 248/118.5, 371, 376, 377, 291, 917, 918; 400/715

[56] References Cited

U.S. PATENT DOCUMENTS

| | | | |
|---|---|---|---|
| 1,628,030 | 5/1927 | Catlett | 248/118 X |
| 3,622,115 | 11/1971 | Tone | 248/371 |
| 4,480,809 | 11/1984 | Healey | 248/291 X |
| 4,545,554 | 10/1985 | Latino . | |
| 4,913,390 | 4/1990 | Berke . | |
| 5,040,760 | 8/1991 | Singer | 248/918 X |
| 5,048,784 | 9/1991 | Schwartz et al. . | |
| 5,050,826 | 9/1991 | Johnston | 248/118.3 |
| 5,088,668 | 2/1992 | Grimm . | |
| 5,104,073 | 4/1992 | Van Beek et al. | 248/918 X |
| 5,108,057 | 4/1992 | Dandy, III et al. | 248/118 |
| 5,135,190 | 8/1992 | Wilson | 248/118.1 |
| 5,163,646 | 11/1992 | Engelhardt | 248/118 |
| 5,183,230 | 2/1993 | Walker et al. | 248/118 |

FOREIGN PATENT DOCUMENTS

| | | | |
|---|---|---|---|
| 8501648 | 4/1985 | WIPO | 248/371 |

*Primary Examiner*—Alvin C. Chin-Shue
*Assistant Examiner*—Derek J. Berger
*Attorney, Agent, or Firm*—Hodgson, Russ, Andrews, Woods & Goodyear

[57] ABSTRACT

A wrist support device (10) that is positioned in front of a computer keyboard, typewriter or the like to support a typist's hands at the keyboard, is described. The wrist support device comprises a pair of blocks (12, 14) having similar rectangular shapes along a longitudinal axis A—A of the device and that pivotally support an intermediate support tray (16) holding an associated wrist rest (18). The longitudinal axis is spaced from and parallel with a rotation axis B—B provided by a pair of bolts (62, 76) connecting between the support tray and the support blocks. This provides for adjusting the tilt angle of the wrist support by rotating the support tray and wrist support about the rotation axis. In addition, the off-center rotation axis provides for adjusting the vertical height of the wrist support above a support surface (48) by positioning the support blocks on the support surface on any one of their corresponding similar sides.

20 Claims, 2 Drawing Sheets

ADJUSTABLE WRIST SUPPORT FOR USE WITH OFFICE MACHINES HAVING A KEYBOARD

BACKGROUND OF THE INVENTION

Field of the Invention

The present invention relates to office machines having a keyboard. In particular, the present invention relates to an adjustable support device that is positioned adjacent a front edge of a keyboard to help support a typist's hands at the keyboard. The keyboard can be of any type including a typewriter and a computer keyboard. The problem is that people working at keyboards are required to make many finger and hand movements over extended periods of time. If the typing is performed with the hands in an unsupported position, muscles in the wrists can become strained and fatigued, which puts pressure on the nerves leading to the hands and fingers. This can lead to a hand-debilitating injury known as Carpal Tunnel Syndrome.

The adjustable wrist support device of the present invention is therefore a device that is useful for supporting a typist's hands at a keyboard to help prevent Carpal Tunnel Syndrome and other like typing related injuries and to also afford the typist a comfortable hand position at the keyboard. The wrist support device comprises a pair of spaced apart, block shaped support members, each having similarly shaped rectangular cross-sections along a longitudinal axis of the support blocks. A wrist rest member generally having an inverted U-shaped cross-section, is mounted between the support blocks along a rotation axis, which is parallel to the longitudinal axis. The upper, rest side of the wrist rest is preferably provided with padded material for added comfort. The off-center axis of rotation provides for adjusting the vertical height of the wrist rest above the keyboard table by positioning the two support blocks on the keyboard table on one of their correspondingly identical sides. That way, independent of which one of the identical sides is supported on the table, the rotation axis will either be above or below a horizontal plane through the longitudinal axis. This provides the wrist rest with a plurality of height elevations which are only limited by the number of identical sides comprising the support blocks. Tilt of the wrist rest is also adjustable in both forward and backward directions by rotating the wrist rest about the rotation axis. The desired tilt can be then locked in place by hand wheel means that thread against the support blocks to hold the tilt of the intermediate wrist rest in a compression-fit. Thus, the wrist support device of the present invention enables a typist to quickly and easily adjust both the vertical height and the tilt of the wrist rest to provide a comfortable hand position for typing.

PRIOR ART

Various adjustable devices have been described in the prior art for supporting a typist's wrists and hands at a keyboard. The majority of these devices are mechanically complicated and several of them do not provide for adjusting the tilt of the wrist rest member.

U.S. Pat. No. 4,545,554 to Latino et al describes a wrist support device for use with office machines such as those having a keyboard. The wrist support device is mounted on a support table in front of the keyboard and is comprised of a support bar having a slightly inclined surface for supporting the typist's wrists. The vertical height of the support bar is adjustable by means of two rotatable wheels that are turned to raise or lower the support bar. This device does not provide for adjusting the tilt of the support bar.

U.S. Pat. No. 4,913,390 to Berke describes a wrist support device that comprises a base member having a vertically upturned portion that supports a wrist plate having a horizontally extending wrist support bar. The vertical height of the support bar is adjustable by loosening wing nuts and sliding the wrist plate along slots provided in the plate. This wrist support device is provided with suction members that extend upwardly from opposed sides of the base member and attach to opposite sides of the keyboard to adjust the horizontal position of the wrist support bar with respect to the front of the keyboard. This device also does not provide any means for adjusting the tilt of the wrist support bar.

U.S. Pat. No. 5,048,784 to Schwartz et al describes an adjustable wrist support device that is mounted on the front edge of an adjustable insert supporting a keyboard. The wrist support device comprises a pair of adjustable, L-shaped support brackets mounted on either side of an intermediate wrist support bar. Adjusting bolts provide for relative friction tension between the two leg members comprising each support bracket. This provides for adjusting the vertical and horizontal position of the support bar along with the tilt of the support bar. This wrist support device is mechanically more complicated than the device of the present invention.

U.S. Pat. No. 5,088,668 to Grimm describes a wrist support device comprised of a support member having a partially cylindrical shape and a concentric base member having a similar, partially cylindrical shape. The support member has dovetail tenons that mate with longitudinal grooves or mortise slots in the base member to provide a locking engagement between the base member and the support member, which are substantially concentric. The dovetail tenons and mortise slots provide for relative rotational movement between the support member and the base member to adjust the vertical height of the support member.

What is not shown by the prior art is a wrist support device for use by an operator such as a typist and the like working at a keyboard or similar typing machine that is easily and quickly changed to adjust both vertical height and tilt of a wrist support member for the hands. In that respect, the wrist support device needs to be mechanically easy to operate so that the typist can always have her hands in a comfortable position as she works at the keyboard. This not only increases worker productivity, but also helps to reduce the occurrence of typing-related hand injuries, such as Carpal Tunnel Syndrome.

OBJECTS OF THE INVENTION

It is therefore an object of the present invention to provide a new adjustable wrist support device for use by people working at a keyboard and the like.

It is also an object of the present invention to provide a new adjustable wrist support device for use by a person working at keyboard and the like that provides for adjusting both the vertical height and the angle of the wrist rest member supporting the hands at the keyboard.

It is still a further object of the present invention to provide a new adjustable wrist support device that is mechanically less complicated than those wrist support devices shown by the prior art.

Furthermore, it is an object of the present invention to provide a wrist support device for use with a keyboard that can be easily and quickly adjusted to vary both the vertical height and the tilt angle of the wrist rest member and that is inexpensive to manufacture and durable in construction.

These and other objects will become increasingly apparent to those of ordinary skill in the art by reference to the following description and to the drawings.

BRIEF DESCRIPTION OF THE PREFERRED EMBODIMENT

FIG. 1 is a longitudinal elevational view of a wrist support device 10 of the present invention comprised of a pair of rectangular support blocks 12 and 14 supporting, in broken length for ease of illustration, an intermediate support tray 16 having an associated wrist support 18 along a rotation axis B—B which is spaced from and parallel with a longtudinal axis A—A of the support blocks 12 and 14.

Figure 4:
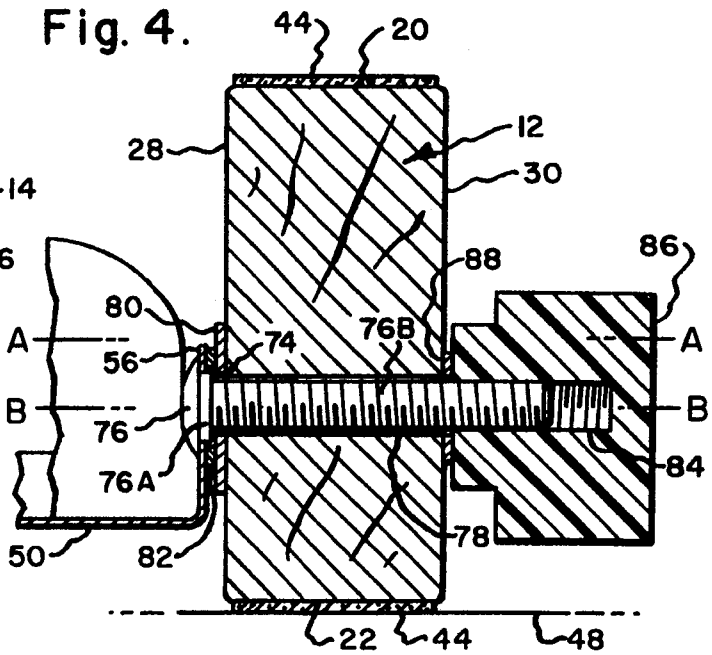
Figure 2:
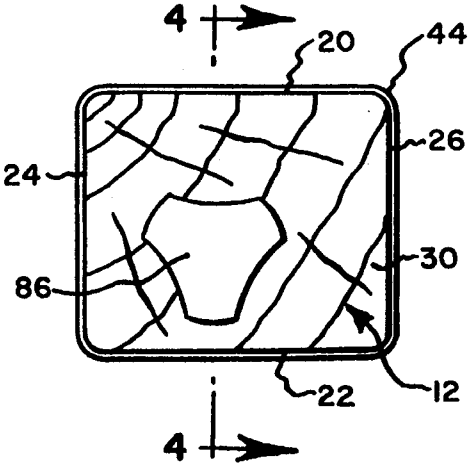
FIG. 2 is an end elevational view along line 2—2 of FIG. 1.

FIG. 4 is a fragmentary cross-sectional view along line 4—4 of FIG. 2, on an enlarged scale, showing the support tray 16 pivotably mounted to support block 12.

Figure 5:
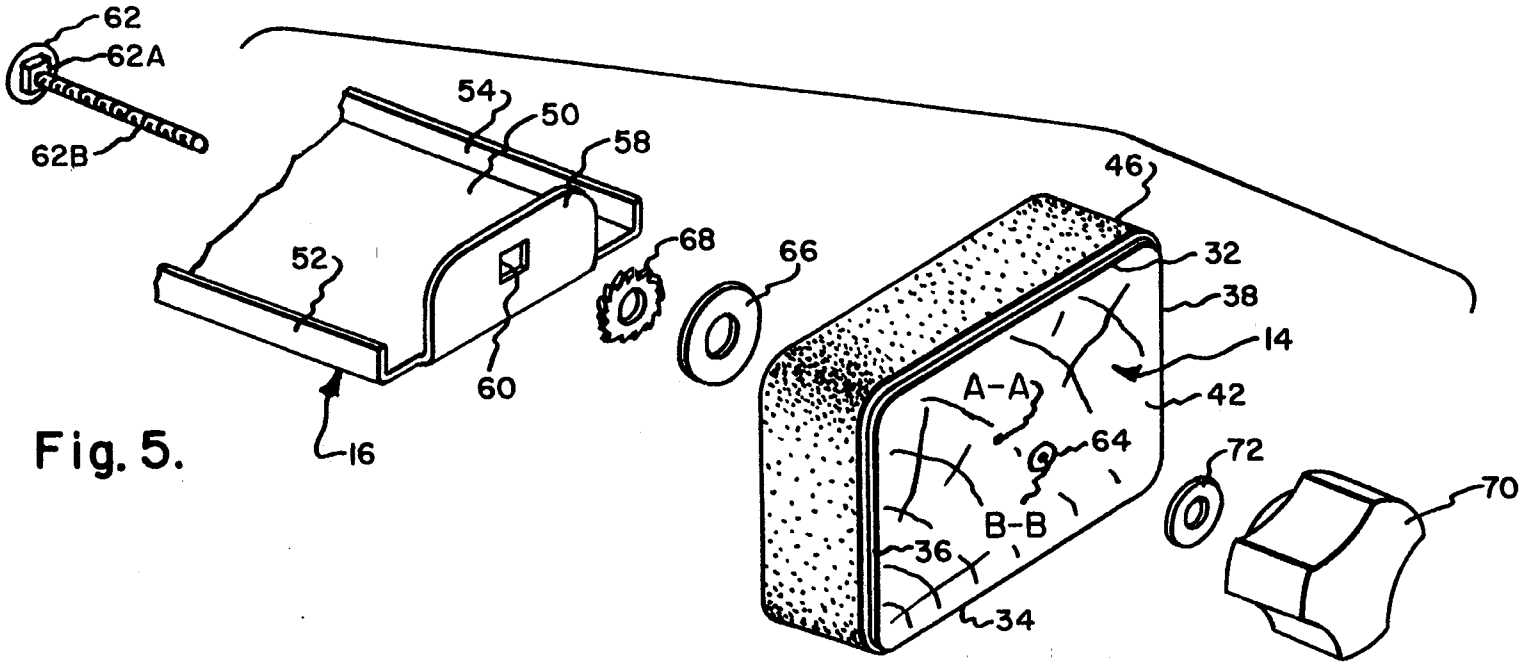

FIG. 5 is an exploded view of the wrist support device 10 of the present invention from the direction of support block 14 with support tray 16 broken away.

Figure 1:
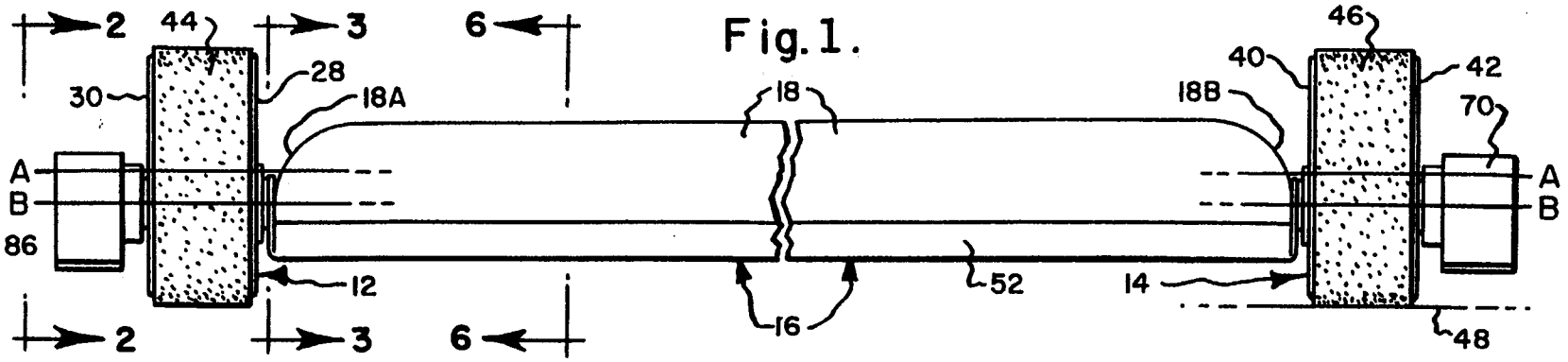
Figures 6, 7, 8, 9:
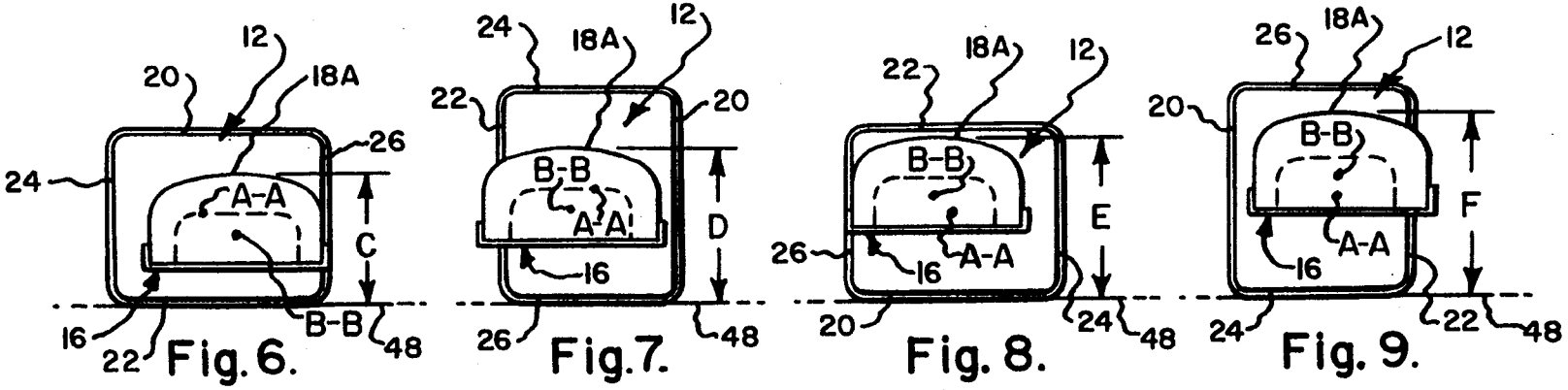

FIG. 6 is an elevational view taken along line 6—6 of FIG. 1 looking towards support block 12 with sidewall 22 resting on the support surface 48.

FIG. 7 is an elevational view along wrist support 18 looking towards support block 12 with sidewall 26 resting on support surface 48.

FIG. 8 is an elevational view along wrist support 18 looking towards support block 12 with sidewall 20 resting on support surface 48.

FIG. 9 is an elevational view along wrist support 18 looking towards support block 12 with sidewall 24 resting on support surface 48.

DESCRIPTION OF THE PREFERRED EMBODIMENT

FIGS. 1 to 9 show the preferred embodiment of the adjustable wrist support device 10 of the current invention. As particularly viewed in FIG. 1, the adjustable wrist support device 10 comprises a pair of opposed left and right support blocks means 12 and 14 which support an intermediate hand rest means comprised of a wrist rest support tray 16 and associated padded wrist rest member 18. As viewed in FIGS. 2 and 4, left support block 12 comprises upper and lower sidewalls 20 and 22 between front and back sidewalls 24 and 26 extending to opposed inner and outer faces 28 and 30. In a similar manner and as viewed in FIGS. 1, 3 and 5, right support block 14 comprises upper and lower sidewalls 32 and 34 between front and back sidewalls 36 and 38 extending to opposed inner and outer faces 40 and 42. The respective sidewalls of support blocks 12 and 14 have similar lengths along a longitudinal axis A—A of the blocks (FIG. 1). Friction strips 44 and 46 preferably made of a soft elastomeric material or similar highly frictional material such as cork are provided around the perimeter of the sidewalls comprising blocks 12 and 14. The friction strips help prevent sliding movement of blocks 12 and 14 on a support surface 48 (FIGS. 1 and 4), such as a table top supporting an associated computer and keyboard (not shown), and the like. The terms "right", "left", "upper", "lower", "front", and "back" simply refer to the orientation of FIGS. 1 to 6 and are not intended to be limiting.

Wrist rest member 18 is supported between the spaced apart blocks means 12 and 14, resting on support tray 16, which is preferably fabricated from a flat sheet of metal material that is cut to the appropriate shape and then bent in a press. This provides support tray 16 with a generally U-shaped cross-section along its length comprised of a flat, rectangular base plate 50 having upwardly extending sides 52 and 54 and opposed end tabs 56 and 58. Base plate 50 can have a variety of widths and lengths to support different sized rest members 18 in front of machines such as computer keyboards, typewriters and the like. The U-shaped cross-section of support tray 16 provides for mounting rest member 18, which has a generally inverted U-shaped cross-section that is supported on base member 50 between sides 52 and 54 and between end tabs 56 and 58. Rest member 18 has rounded ends 18A and 18B adjacent tabs 56 and 58 and is preferably made of blow-molded styrofoam or similarly cushion material. As shown in FIG. 5, end tab 58 which is adjacent block 14 and generally normal to the plane of base plate 50, is provided with square opening 60 that receives a threaded means, such as carriage bolt 62 having a mating square head portion 62A. Bolt 62 has a threaded shaft 62B that extends from head portion 62A and fits through an opening 64 provided between the opposed end faces 40 and 42 of block 14. Opening 64 has a generally cylindrical shape with a longitudinal axis B—B that is spaced from and parallel to the longitudinal axis A—A of block 14. A lock washer 66 and a flat washer 68 are mounted on head portion 62A and shaft 62B between the end tab 58 and block 14. Shaft 62B in turn has a sufficient length to threadably mate with a threaded opening (not shown, same as 84 in FIG. 4) in a hand wheel means or knob 70. A wing nut (not shown) or like device can also be used as the hand wheel means. A flat washer 72, preferably made of a suitable material such as nylon, is mounted on the threaded shaft 62B between block 14 and knob 70.

Figure 3:
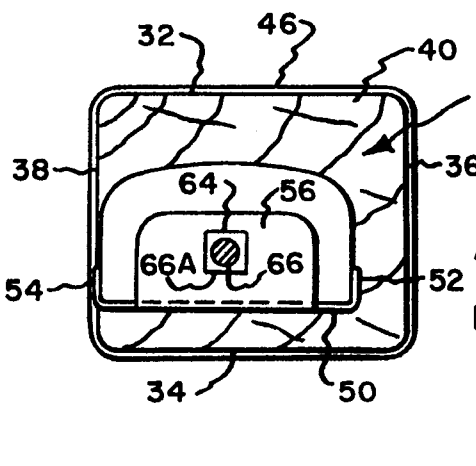
FIG. 3 is a transverse sectional view along line 3—3 of FIG. 1.

In a similar manner and as shown in FIGS. 3 and 4, end tab 56 is provided with a square opening 74 that receives a second carriage bolt 76 having a mating square head portion 76A. Threaded shaft 76B extends from head portion 76A and fits through an opening 78 provided between the opposed end faces 28 and 30 of block 12 while a lock washer 80 and a flat washer 82 are mounted on head portion 76A and shaft 76B between tab 56 and block 12. Opening 78 in block 12 is provided along axis B—B in a correspondingly similar location as opening 64 in block 14 and is spaced from and parallel with the longitudinal axis A—A of block 12. Shaft 76B has a sufficient length to extend beyond outer face 30 of block 12 and threadably mate with a threaded opening 84 in a hand wheel means or knob 86. A flat washer 88, similar to washer 72, is mounted on threaded shaft 76B between block 12 and knob 86. Support tray 16 and its associated wrist support 18 are pivotably supported about axis B—B which comprises a rotation axis provided by bolts 62 and 76 fitted into the openings 64 and 78 provided in blocks 12 and 14. That way, to change the tilt angle of wrist support 18, the hand knobs 70 and 86 are each turned counterclockwise as viewed from respective positions looking at the outer ends of the knobs 70 and 86. This causes the knobs 70 and 86 to unthread from their bolts 62 and 76 so that the support tray 16 is pivotable about the axis B—B provided by bolts 62 and 76 in both forward and backward directions to rotate wrist support 18 to a comfortable position. The knobs 70 and 86 are then turned in an opposite, clockwise direction to provide a locking means that locks the wrist support 18 in place in its adjusted position. In that respect, clockwise rotation of knob 70 causes knob 70 to thread onto shaft 62B of screw 62 and tightened against the outer surface 42 of block 14 with block 14 in turn tightening against washers 66 and 68 and against end tab 58 of support tray 16 to provide for locking support tray 16 in the desired position. Similarly, clockwise rotation of knob 86 causes knob 86 to thread onto shaft 76B of screw 76 and tighten against the outer surface 30 of block 12 which in turn tightens against washers 80 and 82 and against end tab 56 of support tray 16 to provide for locking support tray in the desired position.

As shown in FIGS. 1 and 4, axis of rotation B—B is spaced from and parallel to the longitudinal axis A—A of block 12 and 14. That way, in addition to providing for changing and locking the tilt of wrist support 18, the vertical height of wrist support 18 is also adjustable as shown in FIGS. 6 to 9, which are views looking down wrist support 18 at block 12. Hand knobs 70 and 86 are each turned counterclockwise, as viewed from respective positions looking at the outer ends of the knobs 70 and 86 to cause the hand knobs to unthread from their bolts 62 and 76, respectively. This provides for rotating blocks 12 and 14 respective to support tray 16 to position the blocks on one of their correspondingly similar sides 22 and 34, 26 and 36, 20 and 32, and 24 and 38 to position the support tray 16 and associated wrist support 18 at a comfortable vertical height. The knobs 70 and 86 are then turned in an opposite, clockwise direction, to lock the vertical height of the wrist support 18, as has been previously explained in detail. It should be understood that the adjustments for the vertical height and tilt of the wrist support, although independent of each other, can both be performed while knobs 70 and 86 are in their unthreaded positions and blocks 12 and 14 are rotatable with respect to tray 16 and wrist support 18. The knobs 70 and 86 are then threaded to their tightened position to lock both the vertical height and tilt of wrist support 18.

As shown in FIG. 6 and by way of example of the presently preferred wrist support device 10, when sidewall 22 of block 12 is resting on support surface 48 and block 14 is resting on corresponding sidewall 34 (not shown in FIG. 6), the vertical height C of wrist support surface 18A is about 1.75 inches. As shown in FIG. 7, when sidewall 26 of block 12 and corresponding sidewall 36 of block 14 (not shown in FIG. 7), are resting on support surface 48, the vertical height D of wrist support surface 18A is about 2.0 inches. Further, as shown in FIG. 8, when sidewall 20 of block 12 and corresponding sidewall 32 of block 14 (not shown on FIG. 8), are resting on support surface 48, the vertical height E of wrist support surface 18A is about 2.25 inches. Finally, as shown in FIG. 9, when sidewall 24 of block 12 and corresponding sidewall 38 of block 14 (not shown in FIG. 9), are resting in support surface 48, the height F of wrist support surface 18A is about 2.5 inches. This way, the vertical height of wrist support surface 18A can be varied to any number of heights by providing the blocks 12 and 14 with a correspondingly similar number of sides as long as the axis B—B is off center and parallel to the longitudinal axis A—A of the block 12 and 14.

It is intended that the foregoing description be only representative of the present invention and that the present invention be only limited by the hereinafter appended claims.

What is claimed is:

1. A hand support device positionable on a support surface and adapted for use by a user seated adjacent to a front edge of the support surface for supporting the user's hands in a comfortable position while the user works at the work station, which comprises:

(a) a pair of spaced apart support means each having a plurality of correspondingly similar sides that are positionable on the support surface, wherein a cross-section of each of the support means normal to a first axis of the hand support device, which first axis is generally parallel with and spaced from the front edge of the support surface, is selected from the group consisting of a parallelogram and a convex polygonal with the first axis comprising a central axis of the pair of support means when the cross-section is the parallelogram; and (b) an elongate hand rest means extending to and supported between the pair of support means, the hand rest means being spaced a sufficient vertical height above the support surface and being aligned along the first axis when the cross-section of the support means is the convex polygonal and aligned along a second axis that is spaced from and parallel with respect to the first axis when the cross-section of the support means is the parallelogram and wherein the hand rest means is rotatable about the first axis of the convex polygonal and about the second axis of the parallelogram by appropriate rotational movement of the hand rest means about a rotation means connected between the hand rest means and the support means to provide for adjusting an angle of inclination of the hand rest means and wherein the hand support device is rotatable about the respective first axis of the convex polygonal and about the second axis of the parallelogram to provide for adjusting the vertical height of the hand rest means with the pair of support means positionable on the support surface on one of their various correspondingly similar sides to thereby provide the comfortable hand position when the hands are supported on the hand rest means.

2. The hand support device of claim 1 wherein the hand rest means has a generally inverted channel shape extending to and supported between the pair of support means with a curved portion of the channel facing upwardly so that the user's hands rest on the curved portion of the hand rest means as the user works at the work station.

3. The hand support device of claim 2 wherein a cushion means is mounted on the curved portion of the hand rest means to help support the hands resting on the hand rest means.

4. The hand support device of claim 1 further comprised of a locking means provided to lock the angle of the hand rest means.

5. The hand support device of claim 4 wherein the pair of support means each have end faces provided generally normal to the first axis and in a closely spaced relationship with respect to opposed ends of the hand rest means and wherein the pairs of support means support the rotation means connected between the pair of support means and the hand rest means such that the locking means is actuatable to cause at least one of the opposed ends of the hand rest means to move into a friction fit with at least one of the end faces of the support means to lock the angle of inclination of the hand rest means about the first axis of the convex polygonal and about the second axis of the parallelogram and wherein the locking means is releasable to adjust the angle.

6. The hand support device of claim 5 wherein the locking means is comprised of a hand wheel means supported on a threaded shaft means and positioned adjacent to an outer surface of at least one of the support means opposite the end face of the one support means, and wherein the shaft means connect between the hand wheel means and the pair of support means to the opposed ends of the hand rest means, the shaft means serving as the rotation means providing the first axis of the pair of support means having the cross-section of the convex polygonal and the second axis of the parallelogram such that the hand wheel means is rotatable in a first direction to threadingly engage the shaft means and provide the friction fit between the end face of the one support means and the one end of the hand rest means to lock the angle of inclination of the hand rest means about the respective first axis of the convex polygonal and about the second axis of the parallelogram and wherein the hand wheel means is rotatable in a second direction to unthread from the shaft means to release the friction fit and provide for adjusting the angle of inclination of the hand rest means.

7. The hand support device of claim 6 wherein there are provided a pair of hand wheel means, each one supported on threaded shaft means connected to respective ones of the support means and opposed ends of the hand rest means.

8. The hand support device of claim 1 wherein the pair of support means are comprised of block means, each having the similar parallelogram or convex polygonal cross-sections normal to the first axis to thereby provide the various correspondingly similar sides.

9. A method for supporting a user's hands in a comfortable position while the user works at a work station, which comprises:

(a) providing a hand support device positionable on a support surface and adapted for use by a user seated adjacent to a front edge of the support surface as the user works at the work station, the hand support device comprising:

a pair of spaced apart support means each having a plurality of correspondingly similar sides that are positionable on the support surface, wherein a cross-section of each of the support means normal to a first axis of the hand support device, which first axis is generally parallel with and spaced from the front edge of the support surface, is selected from the group consisting of a parallelogram and a convex polygonal with the first axis comprising a central axis of the pair of support means having the cross-section of the parallelogram; and an elongate hand rest means extending to and supported between the pair of support means, wherein the hand rest means is spaced a sufficient vertical height above the support surface and is aligned along the first axis when the cross-section of the support means is the convex polygonal and is aligned along a second axis that is spaced from and parallel with respect to the first axis when the cross-section of the support means is the parallelogram to provide for adjusting the vertical height of the hand rest means by appropriate rotational movement of the hand support device about the respective first axis of the convex polygonal and about the second axis of the parallelogram when the pair of support means are positioned on the support surface on one of their various correspondingly similar sides;

(b) positioning the pair of support means on the support surface on one of their various correspondingly similar sides by rotating the hand support device about the respective first axis of the convex polygonal and about the second axis of the parallelogram to adjust the vertical height of the hand rest means to a comfortable height for the user; and (c) placing the hands on the hand rest means in the comfortable position as the user Works at the work station.

10. The method of claim 9 wherein the support means are comprised of block means, each having the similar parallelogram or convex polygonal cross-section normal to the first axis to thereby provide the various correspondingly similar sides and wherein rotating the block means about their respective first axis of the convex polygonal and about the second axis of the parallelogram and positioning the pair of blocks means on the support surface on one of their various correspondingly similar sides to thereby adjust the vertical height of the hand rest means at the comfortable height as the user works at the work station.

11. The method of claim 9 wherein the hand rest means is supported between the pair of support means and is also rotatable about the first axis of the pair of support means having the cross-section of the convex polygonal and about the second axis of the pair of support means having the cross-section of the parallelogram provided by rotation means connected between the hand rest means and the pair of support means, and wherein the vertical height of the hand rest means above the support surface is sufficient to provide for adjusting an angle of inclination of the hand rest means by appropriate rotational movement of the hand rest means about the respective first axis of the convex polygonal and about the second axis of the parallelogram and further adjusting the angle of inclination of the hand rest means by rotating the hand rest means about the respective first and second axes.

12. The method of claim 11 wherein the hand rest means has a generally inverted channel shape extending to and supported between the pair of support means with a curved portion of the channel facing upwardly and further resting the hands on the curved portion of the hand rest means to provide for supporting the user's hands at the work station.

13. The method of claim 11 wherein a locking means is provided to lock the angle of inclination of the hand rest means and adjusting the angle of inclination of the hand rest means to the comfortable angle, and then actuating the locking means to lock the angle of inclination of the hand rest means as the user works at the work station.

14. The method of claim 13 wherein the pair of support means each have end faces provided generally normal to the first axis and in a closely spaced relationship with respect to opposed ends of the hand rest means and wherein the pair of support means support the rotation means connected between the support means and the hand rest means and wherein further actuating the locking means to cause at least one of the opposed ends of the hand rest means to move into a friction fit with at least one of the end faces of the support means to lock the angle of inclination of the hand rest means about the rotation axis and wherein releasing the locking means and adjusting the angle of inclination.

15. A hand support device positionable on a support surface and adapted for use by a user seated adjacent to a front edge of the support surface for supporting the-user's hands in a comfortable position while the user works at the work station, which comprises:

(a) a pair of spaced apart support means, each having a plurality of correspondingly similar sides that are positionable on the support surface, wherein a cross-section of each of the support means normal to a first axis of the hand support device, which first axis is generally parallel with and spaced from the front edge of the support surface, is selected from the group consisting of a parallelogram and a convex polygonal with the first axis comprising a central axis of the pair of support means when the cross-section is the parallelogram; and (b) an elongated hand rest means extending to and supported between the pair of support means, the hand rest means being spaced a sufficient vertical height above the support surface and aligned along the first axis when the cross-section of the support means is the convex polygonal and aligned along a second axis that is spaced from and parallel with respect to the first axis when the cross-section of the support means is the parallelogram to provide for adjusting the vertical height of the hand rest means by appropriate rotational movement of the hand support device about the respective first axis of the convex polygonal and about the second axis of the parallelogram with the pair of support means positioned on the support surface on one of their various correspondingly similar sides to thereby provide the comfortable hand position when the user's hands are supported on the hand rest means.

16. The hand support device of claim 15 wherein the hand rest means is also rotatable about the first axis of the pair of support means having the cross-section of the convex polygonal and about the second axis of the pair of support means having the cross-section of the parallelogram, the respective first and second axes provided by rotation means connected between the hand rest means and the pair of support means and wherein the vertical height of the hand rest means above the support surface is sufficient to provide for adjusting an angle of inclination of the hand rest means by appropriate rotational movement of the hand rest means about the rotation means.

17. The hand support device of claim 16 further comprised of a locking means provided to lock the angle of inclination of the hand rest means.

18. The hand support device of claim 17 wherein the pair of support means each have end faces provided generally normal to the first axis and in a closely spaced relationship with respect to opposed ends of the hand rest means and wherein the pair of support means support the rotation means connected between the support means and the hand rest means such that the locking means is actuatable to cause at least one of the opposed ends of the hand rest means to move into a friction fit with at least one of the end faces of the support means to lock the angle of inclination of the hand rest means about the first axis of the convex polygonal and about the second axis of the parallelogram and wherein the locking means is releasable to adjust the angle.

19. The hand support device of claim 18 wherein the locking means is comprised of a hand wheel means supported on a threaded shaft means and positioned adjacent to an outer surface of at least one of the support means opposite the end face of the one support means, and wherein the shaft means connects between the hand wheel means and through the pair of support means to opposed ends of the hand rest means, the shaft means serving as the rotation means provided along the first axis of the pair of support means having the cross-section of the convex polygonal and along the second axis of the pair of support means having the cross-section of the parallelogram such that the hand wheel means is rotatable in a first direction to threadingly engage the shaft means and provide the friction fit between the end face of the one support means and the one end of the hand rest means to lock the angle of inclination of the hand rest means about the respective first and second axes and wherein the hand wheel means is rotatable in a second direction to unthread from the shaft means to release the friction fit and provide for adjusting the angle of inclination of the hand rest means.

20. The hand support device of claim 15 wherein the hand rest means has a generally inverted channel shape extending to and supported between the pair of support means with a curved portion of the channel facing upwardly so that the user's hands rest on the curved portion of the hand rest means as the user works at the work station.

* * * * *